US005158278A

United States Patent [19]

Auf der Mauer

[11] Patent Number: 5,158,278

[45] Date of Patent: Oct. 27, 1992

[54] APPARATUS FOR FORMING A GAP IN AN IMBRICATED STREAM OF SUBSTANTIALLY FLAT PRODUCTS

[75] Inventor: Konrad Auf der Mauer, Gossau, Switzerland

[73] Assignee: Ferag AG, Hinwil, Switzerland

[21] Appl. No.: 821,191

[22] Filed: Jan. 16, 1992

[30] Foreign Application Priority Data

Jan. 25, 1991 [CH] Switzerland ..... 00236/91

[51] Int. Cl.[5] ..... B65H 5/34

[52] U.S. Cl. ..... 271/270; 271/202; 271/182; 271/302; 271/197; 198/462; 198/419.2

[58] Field of Search ..... 271/202, 270, 280, 302, 271/303, 149, 310, 312, 313, 182, 183, 196, 197, 216, 276; 198/462, 418.9, 419.2

[56] References Cited

U.S. PATENT DOCUMENTS

| | | | |
|---|---|---|---|
| 4,534,550 | 8/1985 | Reist | 271/197 |
| 4,585,227 | 4/1986 | Müller | 271/270 |
| 4,948,114 | 8/1990 | Bowman et al. | 271/202 |
| 5,050,859 | 9/1991 | Payor | 271/270 |
| 5,054,763 | 10/1991 | Achelpohl et al. | 271/202 |

FOREIGN PATENT DOCUMENTS

| | | |
|---|---|---|
| 2713895 | 10/1977 | Fed. Rep. of Germany . |
| 3831742 | 6/1989 | Fed. Rep. of Germany . |
| 2074990 | 11/1981 | United Kingdom . |

*Primary Examiner*—H. Grant Skaggs
*Attorney, Agent, or Firm*—Oblon, Spivak, McClelland, Maier & Neustadt

[57] ABSTRACT

A first conveyor is adjoined downstream, as viewed in a predetermined conveying direction for an imbricated product stream, by a gap-forming device. A gap is formed in the imbricated product stream by means of the gap-forming device which feeds the imbricated product stream to a second conveyor. The gap-forming device comprises a belt conveyor provided with two laterally spaced transport belts, as well as an accelerating conveyor arranged between the two transport belts. A conveyor belt of the accelerating conveyor comprises passages which are distributed over approximately one half of its length. At the region of the conveying-active path of the conveyor belt, the passages are in connection with a suction trough. In order to form a gap in the imbricated product stream, the conveyor belt is driven at a higher speed than the belt conveyor, and the suction trough is connected to a negative pressure source. As a result, the products lying on the accelerating conveyor at the beginning of gap formation are sucked onto the conveyor belt and accelerated by the latter, while the following or trailing products are further conveyed at a lower speed by means of the belt conveyor.

26 Claims, 4 Drawing Sheets

APPARATUS FOR FORMING A GAP IN AN IMBRICATED STREAM OF SUBSTANTIALLY FLAT PRODUCTS

CROSS-REFERENCE TO RELATED PATENT APPLICATION

This application is related to the commonly assigned, copending U.S. patent application Ser. No. 07/769,835, filed Oct. 2, 1991, entitled "APPARATUS FOR SELECTIVELY TRANSFERRING PRODUCTS FROM AN IMBRICATED FORMATION CONVEYED ALONG A FIRST CONVEYING PATH ONTO A SECOND CONVEYING PATH".

BACKGROUND OF THE INVENTION

The present invention broadly relates to infeeding and outfeeding substantially flat products arriving in an imbricated or shingled formation and pertains, more specifically, to a new and improved apparatus for forming a gap in an imbricated stream of substantially flat products, particularly printed products.

Generally speaking, the apparatus of the present invention is of the type comprising a first conveyor driven at a first conveying speed, at least one second conveyor arranged downstream of the first conveyor as viewed in a predetermined product conveying direction, and a gap-forming device arranged between the first conveyor and the at least one second conveyor. The gap-forming device comprises first conveying means and second conveying means extending substantially parallel to the latter, whereby the first conveying means are drivable substantially at the first conveying speed for the purpose of conveying the imbricated product stream supplied by the first conveyor to the at least one second conveyor. For the purpose of forming a gap in the imbricated product stream, one of the two conveying means is drivable at a second conveying speed which is higher with respect to the first conveying speed, in order to feed the products located at the beginning of gap formation at the region of the gap-forming device to the at least one second conveyor, and the other one of the two conveying means is drivable at most at the aforesaid first conveying speed, in order to take over and further convey the products supplied by the first conveyor.

An apparatus for forming a gap in an imbricated stream of substantially flat products is known, for example, from German Patent No. 2,852,603, published Oct. 23, 1980 and its cognate British Patent Application No. 2,037,714, published Jul. 16, 1980. The cardboard sheet stacking apparatus disclosed therein comprises a separating station or gap-forming unit provided between a first conveyor and a second conveyor. The separating station consists of an endless conveyor belt for feeding the sheet flow coming in an imbricated formation from the first conveyor to the second conveyor, the endless conveyor belt being always driven at the same speed as the second conveyor. Coaxially with the reversing or deflection rolls of the endless conveyor belt, there are arranged chain wheels over which an endless chain runs, one run length of which carries louvre strips. In the normal case, i.e. when no interruption in the sheet flow is required, the endless chain is not in operation and the strips are not in the conveying-active run of the endless conveyor belt. When the provision of a gap in the imbricated sheet flow becomes necessary, the endless chain is driven at a speed which corresponds to the speed of the first conveyor. The louvre strips coming into the upper run section lift the sheets arriving from the first conveyor and thereby separate them from the sheets on the conveyor belt. At the same time, the drives of the endless conveyor belt and the second conveyor have been stepped up to a higher speed, so that the sheet-flow section on the endless conveyor belt is cleared away. Due to the fact that the endless conveyor belt and the second conveyor run at increased speed, the necessary gap occurs in the sheet flow. The increased speed of the endless conveyor belt and of the second conveyor is successively reduced to the original slower speed as soon as the last sheet of the separated sheet-flow section leaves the respective belt. The cardboard sheets lying on the louvre strips are supplied at unvaried speed to the second conveyor and the endless chain is further driven until the louvre section is no longer at the region of the conveying-active run. The cardboard sheets following the louvre section are fed to the second conveyor by means of the endless conveyor belt driven at the original speed thereof.

An apparatus for subdividing a continuous stream of overlapping paper sheets into a succession of discrete sections of equal length while avoiding a change of overlap of the products in an imbricated array is known, for example, from Swiss Patent No. 660,353, published Apr. 15, 1987 and its cognate U.S. Pat. No. 4,585,227, granted Apr. 29, 1986. This known apparatus comprises a first conveyor which is structured as a belt conveyor and driven at a constant first speed. The discharge end of the first conveyor is adjacent to the receiving end of a second conveyor likewise structured as a belt conveyor, the length of which is at least equal to the length of a section of the stream of overlapping paper sheets. At the end region of the first conveyor there is provided an accelerating device comprising an endless chain conveyor which is adjacent and parallel to the conveying-active run of the first conveyor and carries a flexible elastic portion in the form of a rubber pad, the length of which approximately matches the length of the upper conveying-active run of the endless chain conveyor. The level of the upper conveying-active run of the endless chain conveyor is selected in such a manner that the rubber pad invariably extends into the path which is defined by the upper conveying-active run of the first conveyor while such pad advances in the stream conveying direction. The accelerating device and the second conveyor are driven by a variable-speed motor at the constant first speed of the first conveyor, or at a second speed which exceeds the constant first speed. The accelerating device and the second conveyor are driven at the constant first speed until the entire rubber pad is located in the path which is defined by the conveying-active run of the first conveyor. During this period the paper sheets infed by the first conveyor are passed on to the second conveyor and conducted away by the latter at the constant first speed. The trailing end of the rubber pad having now entered the aforesaid path, the endless chain conveyor of the accelerating device and the second conveyor are accelerated to run at the higher second speed. As a result, the paper sheets lying on the rubber pad and the paper sheets lying on the second conveyor are co-accelerated, and the paper sheets lying on the rubber pad are fed to the second conveyor without a change of the mutual overlap. There is thereby formed a gap between the last sheet on the rubber pad and the next following sheet as viewed in the sheet conveying direction. The speed of the motor is reduced back to the constant first speed when the trailing end of the formed section has advanced beyond the discharge end of the first conveyor. This state-of-the-art apparatus is provided for subdividing a continuous stream of overlapping sheets or for separating discrete sections of a selected length from the leader of a stream of sheets, but is not suitable for forming gaps at any random locations or any predetermined locations within an imbricated product stream.

A further apparatus for forming a gap within the imbricated stream or flow of substantially flat products is disclosed, for example, in German Patent Application No. 3,831,742, published Jun. 22, 1989. This known apparatus comprises two horizontally arranged transport belts driven at the same speed. The delivery end of the first transport belt slightly overlaps the receiving end of the second transport belt, so that the products supplied by the first conveyor descend onto the second conveyor and form a new imbricated formation for further conveyance on the second conveyor. The gap-forming device comprises a perforated belt or tape which is arranged between laterally spaced belts of the second conveyor and revolvingly driven at a lower speed with respect to the speed of the transport belts. The perforated belt or tape is provided with sections of suction holes and guided over a suction trough. In order to form a gap in the aforesaid new imbricated formation, the perforated belt is driven at the aforesaid lower speed, so that the products descending into the tape section with the suction holes are held or retained at the perforated belt or tape and further conveyed with the following descending products at the lower speed, while the leading products downstream of the tape section provided with the suction holes are conveyed at unchanged speed by means of the second conveyor and form thereby the gap. At the region of the perforated belt or tape during the gap-forming operation, the overlap of the aforesaid new imbricated stream of products is increased. As soon as the suction holes depart from the region of the suction trough, all products arriving from the first conveyor are again conveyed at the same original speed.

SUMMARY OF THE INVENTION

Therefore, with the foregoing in mind, it is a primary object of the present invention to provide a new and improved construction of apparatus for forming a gap in an imbricated stream of substantially flat products, especially printed products, and which does not exhibit the drawbacks and shortcomings of the prior art constructions.

In keeping with the immediately preceding object, it is a further object of the present invention to provide a new and improved apparatus for forming a gap of a given or determinate length within an imbricated product stream and which requires a minumum of space in the product conveying direction.

Yet a further significant object of the present invention aims at providing a new and improved apparatus for forming a gap within a stream of overlapping printed products, typically newspapers, periodicals and the like which are selectively or alternatively transferred to a number of outbound conveyors, and which apparatus is of relatively simple construction and design, economical to manufacture and yet affords highly reliable operation.

Now in order to implement these and still further objects of the invention, which will become more apparent as the description proceeds, the apparatus of the present invention is manifested, among other things, by the features that the at least one second conveyor is driven at approximately the first conveying speed in order to take over and further convey, with an increase in mutual overlap, the products supplied by the one of the two conveying means driven at the second conveying speed, and that the other one of the two conveying means is drivable during gap formation at a third conveying speed which is lower with respect to the first conveying speed in order to take over and further convey, likewise with an increase in mutual overlap, the products supplied by the first conveyor.

There is thus prevented that the processing station arranged downstream of the gap-forming apparatus, as viewed in the product conveying direction, has to be operated at a higher operating speed during gap formation. The overlap increase of the products in an end portion of the leading separated section of the imbricated product stream usually does not need to be corrected in order to restore the initial product overlap, because most processing stations can also process imbricated product streams having a shorter or smaller spacing or pitch between the leading edges of the products, or at least tolerate a certain variation with respect to such spacing or pitch. This positive characteristic of such further processing stations is exploited or utilized to a further extent in that the mutual overlap of the products is also increased at the leading or foremost region of the remainder of the imbricated product stream immediately following the freshly formed gap. As a result, the length of the gap-forming device of the apparatus can be considerably shortened such that the apparatus requires a minimum of space, or the increase of the mutual overlap of successively arranged products can be reduced, while the length of the gap to be formed remains the same.

A lifting of pertinent products for the purpose of clearing the path for the separated stream section and the step-down delivery and deposit of products upon a conveyor with a lower located conveying plane are precluded by the apparatus constructed according to the invention. Air pads or cushions that are possible at the region of such conveyor transfer locations thus cannot occur in the gap-forming apparatus of the present invention, so that a mutually uncontrollable shifting or displacement of products in an imbricated formation is advantageously prevented. If the conveying means drivable at the higher second conveying speed comprises a perforated conveyor belt or band that can be connected to a negative pressure source, the respective products to be accelerated are sucked against the perforated conveyor belt or band such that the individual products in the imbricated formation cannot be shifted or displaced, so that an accurate and correct forming of the gap is ensured even at extremely high processing speeds and accelerations thereby involved. The section of the perforated conveyor belt or band which is not provided with passages or through-holes prevents entrainment of the products that are supplied by the first conveyor during the formation of the gap.

The at least one second conveyor advantageously constitutes two second conveyors, whereby the gap-forming device is constructed as a switch or switching device which is pivotable to-and-fro between the two second conveyors.

The two conveying means, i.e. the first and second conveying means of the gap-forming device, are respectively structured as belt conveyors. One of these belt conveyors comprises a conveyor belt which is provided with passages or through-holes or openings within a section thereof, the length of which approximately corresponds to the length of the operative region of the conveyor belt. The passages or through-holes are connectable at the aforesaid operative region to a negative pressure source, in order to conveying-actively connect the respective products with the conveyor belt and appropriately retain the products thereat.

According to a particularly simple and preferred embodiment, the other belt conveyor defines a conveying or conveyance plane and the operative region of the conveyor belt, i.e. the conveying-active run thereof, is located beneath the conveying or conveyance plane of the other belt conveyor.

This other belt conveyor preferably comprises two transport belts, whereby the conveyor belt located beneath the conveying or conveyance plane of the two transport belts is advantageously arranged between these two transport belts.

The conveyor belt is drivable during gap formation at the second conveying speed, while the two transport belts are drivable (a) at approximately the first conveying speed for transporting the imbricated product stream, and (b) at the third conveying speed for the purpose of forming a gap.

As indicated previously the conveyor belt is structured as a perforated conveyor belt provided with passages or through-holes distributed within a section thereof. The conveying-active run of the conveyor belt is guided over a suction trough or vat which is impingeable with a negative pressure at the beginning of the gap-forming operation. The aforesaid conveyor-belt section with the passages or through-holes is located at the region of the suction trough or vat at the outset of gap formation.

It is here remarked that the conveyor belt as well as the two transport belts are structured as endless belts or bands, and that the conveyor-belt section provided with passages or through-holes covers approximately one half of the length of the endless conveyor belt.

According to a preferred exemplary embodiment the two transport belts and the conveyor belt therebetween are guided at the receiving end and at the delivery end of the gap-forming device around respective deflection rolls seated upon a first common shaft provided at the receiving end, and around respective deflection rolls seated upon a second common shaft provided at the delivery end. The first common shaft is coupled with the respective deflection rolls associated to the transport belts in a manner such as to be non-rotatable relative to the respective deflection rolls. The second common shaft is coupled with the deflection roll associated to the endless conveyor belt in a manner such as to be non-rotatable relative to the deflection roll. The first common shaft and the second common shaft are respectively drivable by means of a driving arrangement at the first and third conveying speeds and at the second conveying speed.

The aforesaid driving arrangement constitutes a driving motor and respective transmission means. The first common shaft is connected to the driving motor by means of first coupling means as well by means of a free-wheel which is active in the predetermined product conveying direction, whereby the transmission means between the driving motor and the first common shaft are structured such that the transport belts revolve (a) at a speed approximately corresponding to the first conveying speed when the first coupling means are engaged and the free-wheel is active, and (b) at the third conveying speed which is lower than the first conveying speed, when the first coupling means are disengaged and the free-wheel is inactive. The second common shaft is connected to the driving motor by means of second coupling means, in order to drive the endless conveyor belt at the second conveying speed while the second coupling means are engaged.

The first conveyor and preferably the at least one second conveyor or, as the case may be, the two second conveyors are drivable by means of the driving motor.

The second conveying speed is between 10% and 50%, preferably approximately 20%, higher than the first conveying speed, and the third conveying speed is between 10% and 50%, preferably approximately 20%, lower than the first conveying speed.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters and numerals to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for forming a gap in an imbricated stream of substantially flat products has been illustrated therein as is needed to enable one skilled in the art to readily understand the underlying principles and concepts of this invention.

Figure 1:
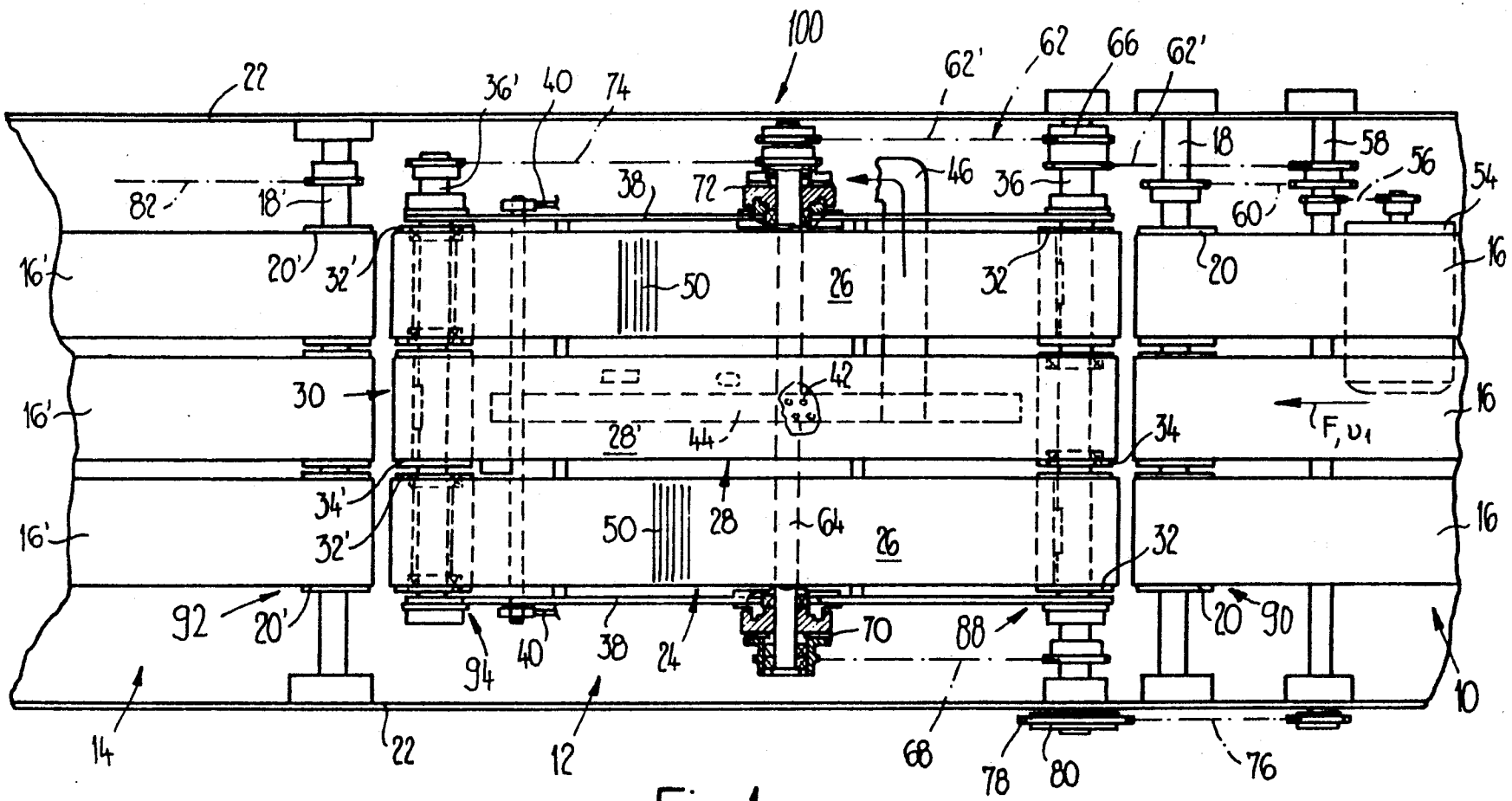
FIG. 1 schematically shows in a top plan view an apparatus for forming a gap in an imbricated stream of flat products and constructed according to the invention.
Figure 2:
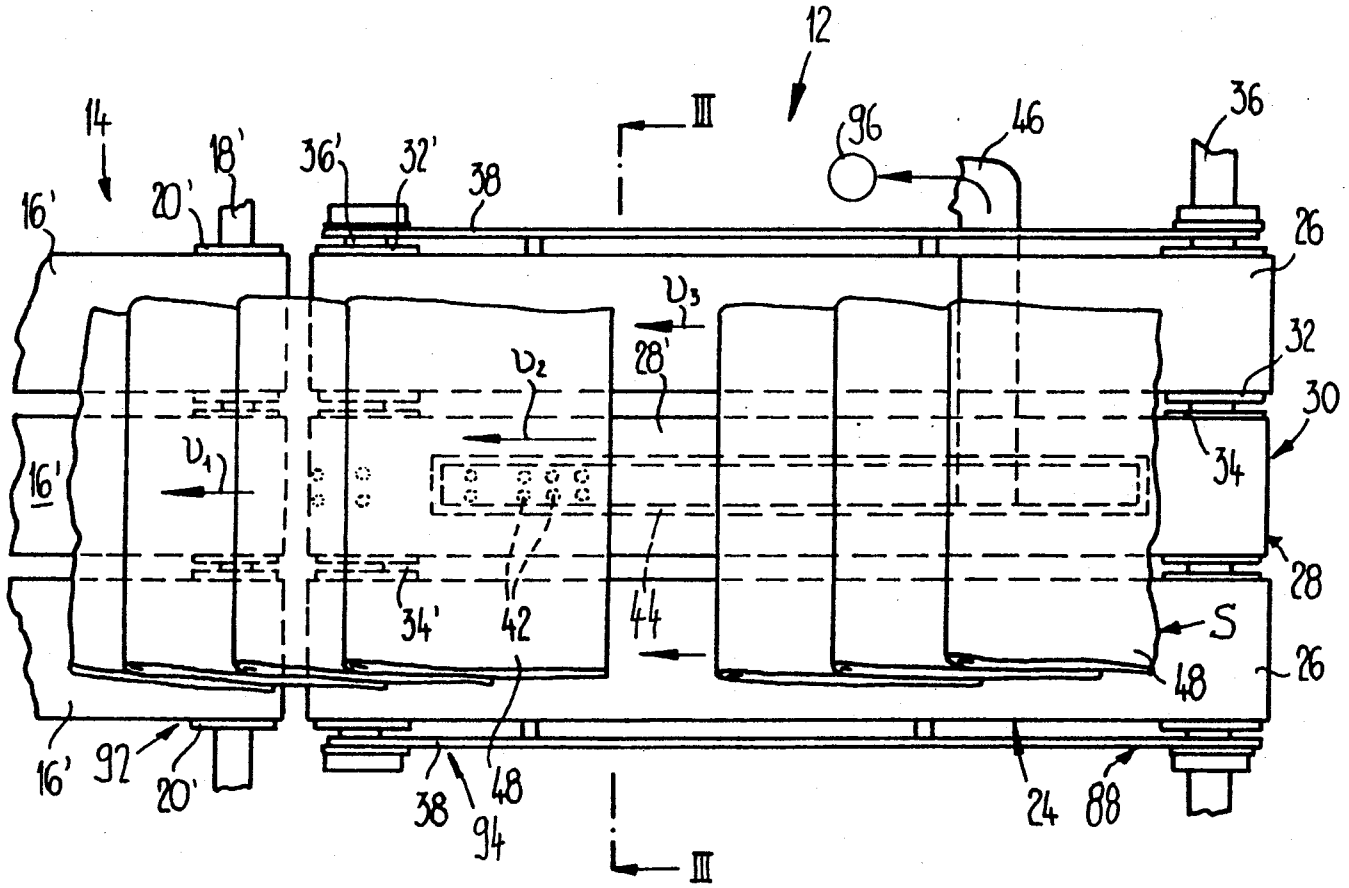
FIG. 2 schematically shows likewise in a top plan view a part of the apparatus according to FIG. 1, wherein the apparatus is depicted in the operating phase of gap formation.
Figure 3:
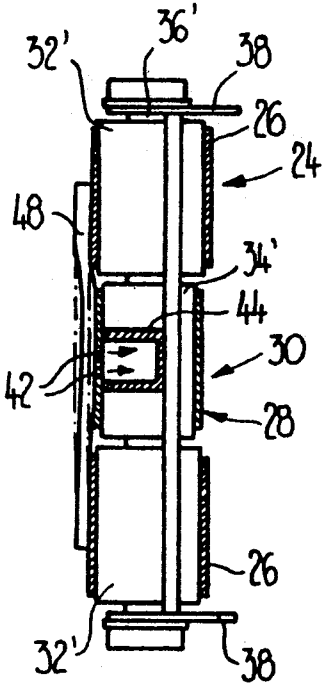
FIG. 3 schematically shows a cross-section taken substantially along the line III—III in FIG. 2.

Turning attention now specifically to FIGS. 1, 2 and 3 of the drawings, an apparatus 100 illustrated therein by way of example and not limitation will be seen to comprise a first conveyor 10 for infeeding an imbricated or shingled stream S of substantially flat products 48 (FIG. 2) and a gap-forming device 12 adjacently arranged downstream of the first conveyor 10, as viewed in a predetermined product conveying direction F. The gap-forming device 12 serves the purpose of forming a gap in the imbricated product stream S and supplying the imbricated product stream S to a second conveyor 14 which is adjacently arranged downstream of the gap-forming device 12. The first conveyor 10 and the second conveyor 14 are constructed in generally known manner as belt conveyors and, therefore, are not shown in their entirety. To simplify the illustration only the delivery end 90 of the first conveyor 10 and the receiving end 92 of the second conveyor 14 are depicted in FIG. 1.

The first conveyor 10 comprises three belts or bands 16 arranged side by side and extending substantially parallel to one another. These three belts or bands 16 are guided at the delivery or conveying-active end 90 thereof around respective rolls or rollers 20 seated upon a shaft 18 in a manner such as to be non-rotatable relative thereto, whereby the shaft 18 is freely rotatably mounted at a stand or frame 22 formed as a bearing shield or equivalent structure. The second conveyor 14 comprises three belts or bands 16' which are arranged side by side and extend substantially parallel to each other. The three belts or bands 16' are guided at their receiving end 92 around respective rolls or rollers 20' seated upon a shaft 18' in a manner such as to be non-rotatable relative thereto. This shaft 18' is also freely rotatably mounted at the stand or frame 22.

The gap-forming device 12 adjoined upstream by the first conveyor 10 and downstream by the second conveyor 14 comprises a receiving end 88, a delivery end 94 and a belt conveyor 24 having two laterally spaced transport belts or bands 26 which extend substantially parallel to one another. Between these two laterally spaced transport belts or bands 26 there extends an endless conveyor belt or band 28 of an accelerating conveyor 30. At the receiving end 88 of the gap-forming device 12, the two transport belts or bands 26 are guided around respective deflection rolls 32 and the endless conveyor belt or band 28 wraps around a deflection roll 34. These deflection rolls 32 and 34 are seated upon a shaft 36. At the delivery end 94 of the gap-forming device 12, the two transport belts or bands 26 are guided around respective deflection rolls 32' and the endless conveyor belt or band 28 wraps around a deflection roll 34'. These deflection rolls 32' and 34' are seated upon a shaft 36'. The two shafts 36 and 36' are connected by means of shield-type bearing brackets 38 which laterally extend on the outside of the two transport belts or bands 26.

The shaft 36 provided at the receiving end 88 of the gap-forming device 12 is freely rotatably mounted at the stand or frame 22, so that the gap-forming device 12 is pivotable to-and-fro in rocker-like manner between an upper stop position and a lower stop position. The drive for such pivoting or swiveling movement is accomplished by means of suitable piston-and-cylinder arrangements 40 which are only schematically indicated in FIG. 1. As seen by referring to FIGS. 4 through 11, the gap-forming device 12 in its upper stop position guides the imbricated product stream S to an upper second conveyor 14'. In the lower stop position of the gap-forming device 12, the imbricated product stream S is appropriately guided to a lower second conveyor designated by reference numeral 14''. The gap-forming device 12 thus serves at the same time as a switch or switching device.

The endless conveyor belt or band 28 of the accelerating conveyor 30 comprises a section provided with passages or through-holes or openings 42 which are only allusively illustrated in the drawings. The length of such belt section matches approximately the length of the conveying-active run 28', i.e. approximately the length of the range of action of the endless conveyor belt or band 28.

The conveying-active run 28' of the endless conveyor belt or band 28 slides over a suction trough or vat 44 extending substantially between the deflection rolls 34 and 34'. The suction trough or vat 44 can be connected via a suction line or channel 46 with a conventional negative pressure source or suction source schematically depicted in FIG. 2 and designated by reference numeral 96. Viewed in a direction substantially parallel to the conveying or conveyance plane of the belt conveyor 24 and substantially at right angles to the predetermined product conveying direction F, it is only necessary to provide the passages or through-holes 42 at the region or range of the suction trough or vat 44.

As best seen by referring to FIG. 3 the deflection rolls 34 and 34', around which the endless conveyor belt or band 28 is guided, are slightly smaller in diameter than the deflection rolls 32 and 32' provided for the transport belts or bands 26. The conveying-active run 28' of the endless conveyor belt or band 28 thus lies slightly beneath the conveying plane defined by the two transport belts or bands 26 of the belt conveyor 24. It is for this reason that, when no passages 42 are located in the region of the suction trough 44 or when no negative pressure prevails in the suction trough or vat 44, the substantially flat products 48 of the imbricated product stream S lying with their lateral end portions or regions on the two transport belts 26 do not contact the endless conveyor belt 28 due to their inherent stiffness or rigidity, as has been depicted by dot-dash lines in FIG. 3, or then bear upon the endless conveyor belt 28 only with a minor part or portion of their weight. In this manner, a speed difference between the transport belts or bands 26 and the endless conveyor belt or band 28 cannot lead to or result in any interference or influence with respect to the products conveyed by the two laterally spaced transport belts or bands 26. In order to improve the adhesion between the substantially flat products 48 and the two transport belts or bands 26, these transport belts 26 are provided with an appropriate profiling 50 which is only schematically depicted in FIG. 1.

The deflection rolls 32 are keyed upon the shaft 36 in a manner such as to be non-rotatable relative thereto, whereas the deflection roll 34 provided therebetween is freely rotatably mounted at the shaft 36. At the delivery end 94 it is the middle deflection roll 34' that is keyed upon the shaft 36' in a manner such as to be non-rotatable relative thereto, while the lateral deflection rolls 32' are freely rotatably mounted at this shaft 36'. Consequently, the transport belts or bands 26 are driven by rotation of the upstream common shaft 36, and the endless conveyor belt or band 28 is driven by rotation of the downstream common shaft 36'.

For the conveyance of the imbricated product stream S when no gap formation is required, the first conveyor 10, the two transport belts or bands 26 of the belt conveyor 24, and the second conveyor 14 are driven at the same initial or first speed $v_1$. The accelerating conveyor 30 is not in operation. However, when a gap is to be formed within the imbricated product stream S, the first conveyor 10 and the second conveyor 14 are still driven at the first speed $v_1$, whereas the endless conveyor belt or band 28 of the accelerating conveyor 30 is now driven at a second speed $v_2$ which exceeds the first speed $v_1$, and the two transport belts or bands 26 are now driven at a third speed $v_3$ which is lower than the first speed $v_1$. Due to the difference between the second speed $v_2$ and the third speed $v_3$, a gap is appropriately formed in the imbricated product stream S. As soon as the first product 48 following the freshly formed gap, as viewed in the predetermined product conveying direction F, has arrived at the delivery end 94 of the gap-forming device 12 and has been delivered to the second conveyor 14, the endless conveyor belt or band 28 is again put out of operation and the two transport belts or bands 26 are again driven at the initial or first speed $V_1$.

At the receiving ends 88 and 92 of the gap-forming device 12 and the second conveyor 14, respectively, there are provided respective weight-loaded or weight rollers 52 and 52' which cooperate with the transport belts or bands 26 and with the belts or bands 16', respectively, as schematically depicted in FIGS. 4 through 11.

The drive arrangement for the first conveyor 10, the second conveyor 14 and the gap-forming device 12 is hereinafter described in greater detail in conjunction with FIG. 1 of the drawings.

A driving motor 54 is operatively connected by means of a schematically indicated first chain drive 56 or equivalent structure with a driving or drive shaft 58 which is rotatably mounted at the stand or frame 22. This driving or drive shaft 58 is coupled, on the one hand, by means of a schematically indicated second chain drive 60 with the shaft 18, which drives the belts 16 of the first conveyor 10, in a manner such as to be non-rotatable relative thereto, and on the other hand, by means of a two-part third chain drive 62 with an intermediate shaft 64 in a manner such as to be non-rotatable relative thereto.

The intermediate shaft 64 is arranged between the upstream common shaft 36 and the downstream common shaft 36' and mounted at the shield-type bearing brackets 38. The two-part third chain drive 62 comprises two chains 62' which are guided around respective chain wheels or sprockets seated upon a common sleeve 66 in a manner such as to be non-rotatable relative thereto, whereby the sleeve 66 is freely rotatably mounted at the shaft 36. This shaft 36 is operatively connected or associated by means of a schematically depicted fourth chain drive designated by reference numeral 68 with the one part of a first coupling or clutch 70, the other part thereof being seated upon the intermediate shaft 64 in a manner such as to be non-rotatable relative thereto. Upon activation of this first coupling or clutch 70, the shaft 36 is appropriately driven by means of the driving motor 54 via the driving or drive shaft 58, the two-part third chain drive 62, the intermediate shaft 64 and the fourth chain drive 68. The transmission gearing or gear ratio is selected such that the two transport belts or bands 26, driven by means of the shaft 36, revolve at the first speed $v_1$, at which the three belts or bands 16 of the first conveyor 10 are driven.

The one part of a second coupling or clutch 72 is seated upon the intermediate shaft 64 in a manner such as to be non-rotatable relative thereto, while the other part thereof is coupled by means of a fifth chain drive 74 with the downstream common shaft 36'. When this second coupling or clutch 72 is deactivated or disengaged, the shaft 36' is not driven and the endless conveyor belt or band 28 of the accelerating conveyor 30 is thus not in operation. However, upon activation of the second coupling or clutch 72 the endless conveyor belt or band 28 is appropriately driven at the second speed $v_2$. The gear ratio between the intermediate shaft 64 and the downstream common shaft 36' is thereby selected such that the second speed $v_2$ exceeds the first speed $v_1$.

The driving or drive shaft 58 is operatively connected or associated by means of a sixth chain drive 76 with a chain wheel or sprocket 78 which is seated by means of a schematically depicted free-wheel 80 upon the shaft 36. The free-wheel 80 is active in the predetermined product conveying direction F. This means that the shaft 36 can rotate at a higher speed, but not at a lower speed than the chain wheel or sprocket 78. The gear ratio between the driving or drive shaft 58 and the chain wheel or sprocket 78 is selected such that, when the first coupling or clutch 70 is deactivated, i.e. when the free-wheel 80 is inactive and the shaft 36 is driven by the chain wheel or sprocket 78, the two transport belts or bands 26 revolve at the third speed $v_3$ which is lower than the initial or first speed $v_1$.

Finally, in FIG. 1 there is schematically shown a seventh chain drive 82 for driving the second conveyor 14. This second conveyor 14 can be driven by means of a suitable motor of its own, but it is also conceivable that the aforesaid seventh chain drive 82 couples the second conveyor 14 with the driving motor 54. As already previously mentioned, the second conveyor 14 is driven at the same first speed $v_1$ as the first conveyor 10.

Having now had the benefit of the foregoing description of the apparatus 100 for forming a gap in the imbricated stream S of the substantially flat products 48 as considered with respect to FIGS. 1, 2 and 3, the mode of operation of the apparatus 100 constructed according to the invention is hereinafter described in conjunction with FIGS. 4 through 11 and is as follows:

The apparatus in FIGS. 4 through 11 is depicted in a fragmentary side view and in a simplified illustration. The reference characters or numerals used in FIGS. 4 through 11 generally correspond with the reference characters or numerals employed in the arrangement of FIGS. 1, 2 and 3 and are only repeated to the extent that they are needed for comprehending the operating phases of the apparatus depicted in FIGS. 4 through 11.

FIGS. 4 through 11 depict the first conveyor 10 for infeeding the imbricated product stream S, in a simplified illustration the gap-forming device 12 adjacently arranged downstream of the first conveyor 10 as viewed in the pre-determined product conveying direction F, and the two second conveyors 14' and 14'' arranged downstream of the gap-forming device 12 as also viewed in the predetermined product conveying direction F. As already previously explained the gap-forming device 12 serves as a switch or switching device which is pivotable about the axis of the downstream common shaft 36 such that the gap-forming device 12 is appropriately adjoined either by the upper second conveyor 14' in the upper stop position, or by the lower second conveyor 14'' in the lower stop position of the pivoting movement.

For reasons of clarity in the illustration of the gap-forming device 12 there has been shown thereof only the accelerating conveyor 30 with the suction trough or vat 44. At the receiving end 88 and at the delivery end 94 of the gap-forming device 12, the endless conveyor belt or band 28 is guided around respective deflection rolls 34 and 34'. A section of the endless conveyor belt or band 28 is provided with the passages or through-holes 42, whereby the length of such belt section approximately matches the length of the conveying-active run 28'. At the tail or end region of the section, as viewed in the predetermined revolving direction of the endless conveyor belt or band 28, the through-hole or passage density is greater than in the remaining section area, in order to particularly hold or retain the product 48 which is to be separated from the next following or upstream product 48. At the receiving end 88 of the gap-forming device 12 and at the receiving end 92 of the second conveyor 14' or, as the case may be, of the second conveyor 14'', there are respectively arranged the weight rollers 52 and 52' which cooperate with the two transport belts or bands 26 not shown in FIGS. 4 through 11 and with the three belts or bands 16', respectively.

Figure 4:
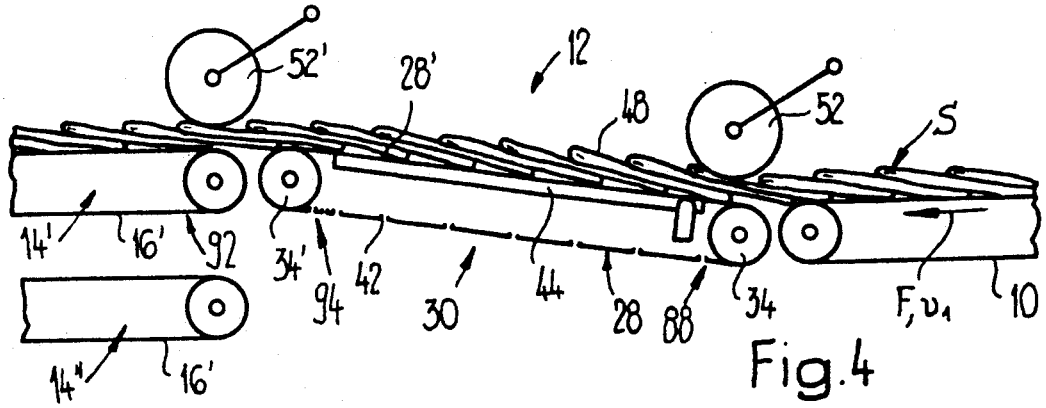
FIG. 4 schematically shows in a side view and in a simplified illustration the apparatus according to FIGS. 1 through 3 in a first operating phase.
Figure 5:
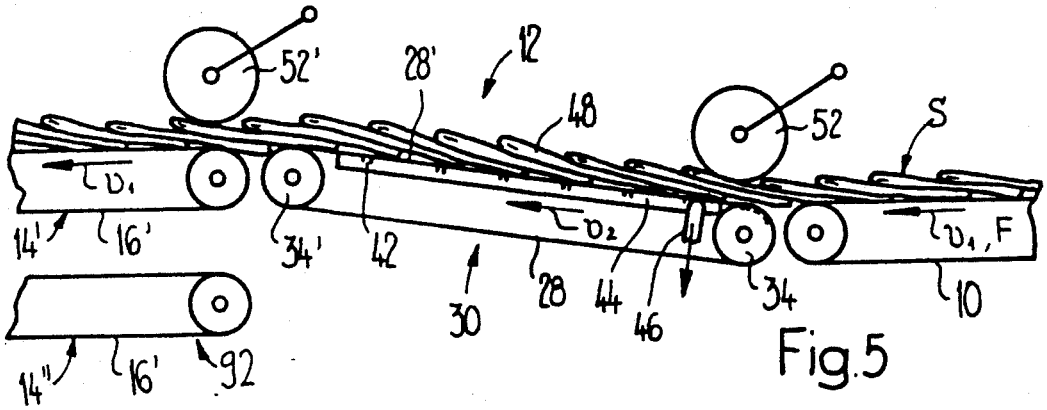
FIG. 5 schematically shows in a side view and in a simplified illustration the apparatus according to FIGS. 1 through 3 in a second operating phase.

In the first operating phase depicted in FIG. 4, the imbricated product stream S supplied by the first conveyor 10 at the first speed $v_1$ in the product conveying direction F is conveyed at unchanged speed by the gap-forming device 12 to the upper second conveyor 14'. To that end the two transport belts or bands 26 depicted in FIGS. 1, 2 and 3 but not in FIGS. 4 through 11, as well as the upper second conveyor 14' are likewise driven at the initial or first speed $v_1$. The passages or through-holes 42 of the endless conveyor belt or band 28 are thereby located at the region of the lower conveying-inactive run, and a pressure balance prevails in the suction trough or vat 44. The first coupling or clutch 70 is thereby engaged and the free-wheel 80 is active (cf. FIG. 1).

Should a gap or interruption in the imbricated product stream S now become necessary, the second coupling or clutch 72 is also activated or engaged. As a result, the endless conveyor belt or band 28 now revolves at the second speed $v_2$ which exceeds the initial or first speed $v_1$ by, for example, approximately 20%. As soon as the first leading passages or through-holes 42 in the endless conveyor belt 28, as viewed in the product conveying direction F, travel toward the upstream end region of the suction trough 44, the latter is connected with the negative pressure source or suction source 96 (cf. FIG. 2), such connection being indicated in FIG. 5 by an arrow leading out of the suction line or channel 46. However, it is to be observed that in this operating phase, i.e. until the vacuum build-up in the suction trough or vat 44 is accomplished, all products 48 of the imbricated formation S are further conveyed at the initial or first speed $v_1$.

The products 48 lying at the outset of gap formation in the active region or area of the accelerating conveyor 30, i.e. at the region of the suction trough 44 and of the passages or through-holes 42, are sucked or drawn with their respective trailing or upstream end portions towards the endless conveyor belt or band 28 by suction acting through the passages 42 and caused by the negative pressure or partial vacuum prevailing in the trough or vat 44, and conveying-actively connected with the endless conveyor belt or band 28 (cf. FIG. 3). In an imbricated product formation, in which each product bears in each case upon the next following or trailing product and not as depicted in the drawings, wherein each product 48 bears in each case upon the next preceding or leading product 48, it is obvious that the respective leading edges or portions of the products are sucked onto the endless conveyor belt 28 and operatively connected with the latter. The respective products 48 are now accelerated by virtue of this operative connection and conveyed at the second speed $v_2$ to the upper second conveyor 14' which, however, further revolves at the initial or first speed $v_1$ (cf. FIG. 6).

Viewed in the predetermined product conveying direction F, the products 48 following the trailing or upstream end of the belt section with the passages 42 and supplied by the first conveyor 10 are now further conveyed at the region of the gap-forming device 12 by the belt conveyor 24 at the third speed $v_3$ which is approximately, for instance, 20% lower than the initial or first speed $v_1$. For this purpose the first coupling or clutch 70 is disengaged. As a result, the free-wheel 80 becomes inactive and the two transport belts or bands 26 are appropriately driven by means of the sixth chain drive 76 (cf.

FIG. 1). Due to the difference between the second speed $v_2$ and the third speed $v_3$, the gap or interruption in the imbricated product stream S is now formed at the region of the gap-forming device 12, as shown in FIGS. 2 and 6.

Figure 6:
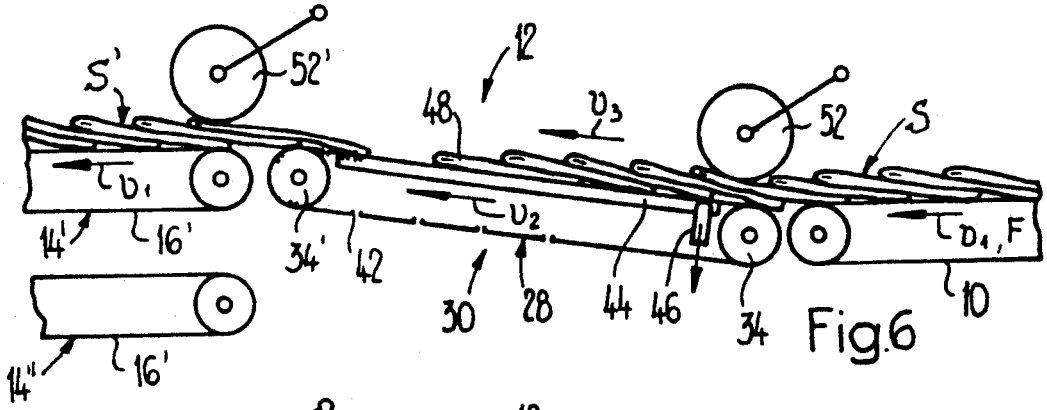
FIG. 6 schematically shows in a side view and in a simplified illustration the apparatus according to FIGS. 1 through 3 in a third operating phase.

In this operating phase depicted in FIG. 6 the weight rollers 52 and 52' develop their full effect. The weight roller 52 ensures braking or deceleration of the products 48, supplied at the first speed $v_1$ by the first conveyor 10, down to the third speed $v_3$ upon transfer thereof to the belt conveyor 24, and appropriately presses the products 48 against the two transport belts or bands 26. At the receiving end 88 of the gap-forming device 12, the mutual overlap of the individual products 48 is thus increased during gap formation according to the difference between the first speed $v_1$ and the third speed $v_3$, and the mutual spacing or pitch between the leading edges or between the trailing edges of the respective products 48 is accordingly decreased. The weight roller 52' acts in precisely the same manner during the transfer from the gap-forming device 12 to the second conveyor 14'. The products 48 delivered by the endless conveyor belt or band 28 at the second speed $v_2$ to the second conveyor 14' are braked down to the first speed $v_1$ at the region of the weight roller 52', whereby the mutual overlap of the products 48 conveyed by the accelerating conveyor 30 at the higher second speed $v_2$ to the second conveyor 14' is increased in accordance with the speed difference between the second speed $v_2$ and the first speed $v_1$. In other words, the spacing or pitch between the leading edges or between the trailing edges of the respective products 48 is decreased or reduced according to the speed difference between the speeds $v_2$ and $v_1$.

Figure 7:
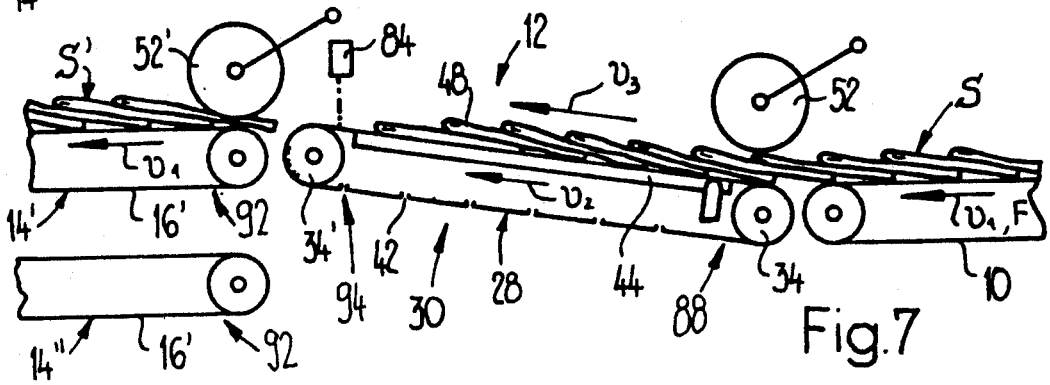
FIG. 7 schematically shows in a side view and in a simplified illustration the apparatus according to FIGS. 1 through 3 in a fourth operating phase.
Figure 8:
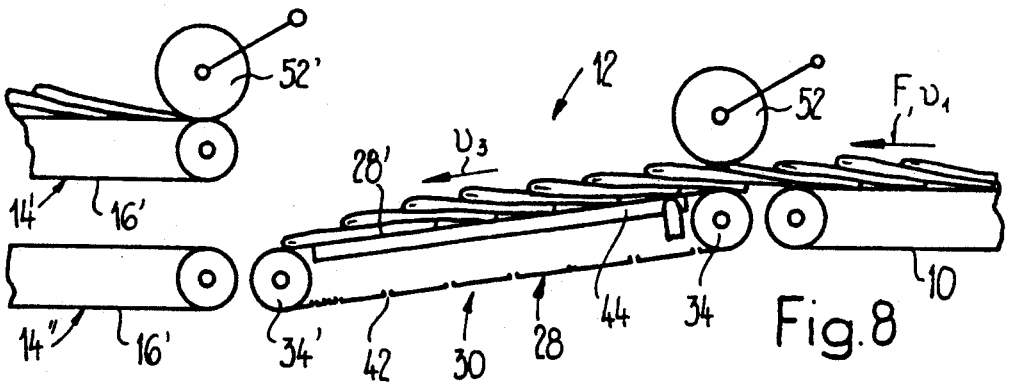
FIG. 8 schematically shows in a side view and in a simplified illustration the apparatus according to FIGS. 1 through 3 in a fifth operating phase.
Figure 9:
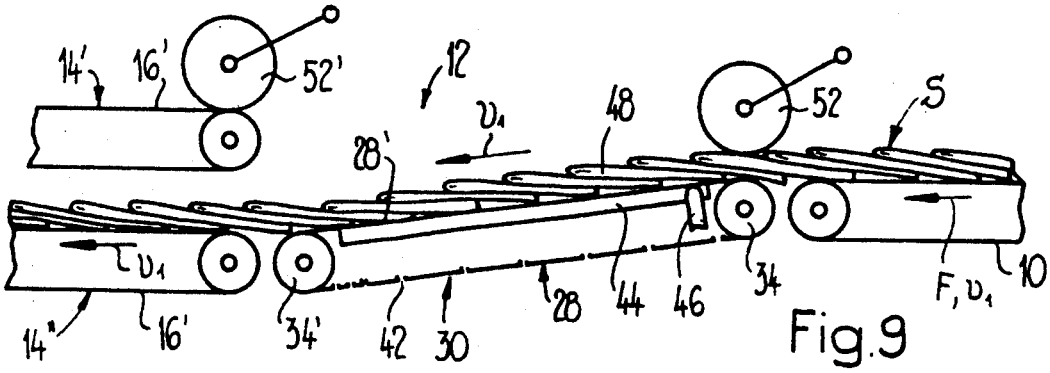
FIG. 9 schematically shows in a side view and in a simplified illustration the apparatus according to FIGS. 1 through 3 in a sixth operating phase.
Figure 10:
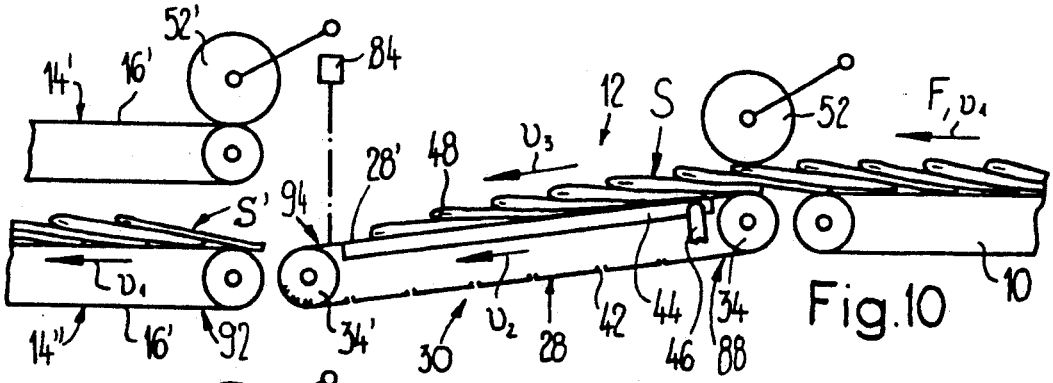
FIG. 10 schematically shows in a side view and in a simplified illustration the apparatus according to FIGS. 1 through 3 in a seventh operating phase.

In FIG. 7 there is schematically indicated a detector or sensor 84, for instance a light or photoelectric barrier provided at the delivery end 94 of the gap-forming device 12. This detector or sensor 84 transmits a signal to a not particularly illustrated control unit as soon as the last product 48 of a stream section conveniently designated by reference character S' and separated by the gap from the infed imbricated product stream S leaves the operative region or range of the endless conveyor belt 28. By virtue of this signal the gap-forming device 12 is pivoted in switch-like manner to the lower stop position thereof, at which the part of the imbricated product stream S following the freshly formed gap is supplied to the lower second conveyor 14'', as depicted in the operating phase according to FIG. 8. The second coupling or clutch 72 is thereby released or disengaged, as soon as the passage or through-hole section of the endless conveyor belt or band 28 is located at the region of the lower conveying-inactive run of the latter, and the pressure in the suction trough 44 is compensated or balanced after the rearmost passages or through-holes 42, as viewed in the predetermined conveying direction F, have left the region or area of the suction trough or vat 44.

Subsequent to the pivoting movement of the gap-forming device 12 to the lower second conveyor 14'', the first coupling or clutch 70 is again activated, with the result that the two transport belts or bands 26 again start to revolve at the first speed $v_1$. The imbricated product stream S is thus fed at the unchanged first speed $v_1$ to the lower second conveyor 14'' and by the latter to a further product processing station, as shown in the operating phase according to FIG. 9.

If a gap is to be formed again at any one location within the imbricated product formation or array S, in order that the following or trailing products 48 as viewed in the conveying direction F can be fed to the upper second conveyor 14', the endless conveyor belt or band 28 is accelerated to the second speed $v_2$ in precisely the aforedescribed manner by activating the second coupling or clutch 72, and the suction trough 44 is again connected to the negative pressure source or suction source 96, in order to deliver the products 48 present at the region of the gap-forming device 12 at the higher speed $v_2$ to the lower second conveyor 14''. Approximately at the same time the two transport belts or bands 26 are braked or decelerated to the third speed $v_3$ by opening the first coupling or clutch 70, in order to further convey at the lower third speed $v_3$ the products 48 arriving from the first conveyor 10 at the initial or first speed $v_1$.

Figure 11:
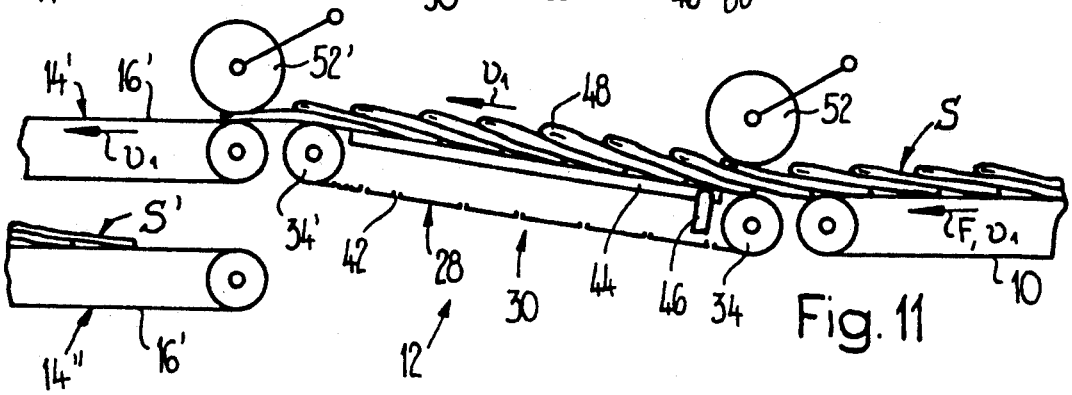
FIG. 11 schematically shows in a side view and in a simplified illustration the apparatus according to FIGS. 1 through 3 in an eighth operating phase.

As soon as the detector or sensor 84 has identified the end of the stream section S' separated from and, viewed in the predetermined conveying direction, running ahead of the imbricated product stream S (FIG. 10), the gap-forming device 12 is pivoted back to the upper stop position, in which the delivery end 94 thereof is in alignment with the receiving end 92 of the upper second conveyor 14'. The endless conveyor belt or band 28 is again stopped by releasing the second coupling or clutch 73 (FIG. 11). Negative pressure in the suction trough 44 is compensated and, due to activation of the first coupling or clutch 70, the transport belts or bands 26 again revolve at the first speed $v_1$.

As already previously explained the second speed $v_2$ preferably exceeds the first speed $v_1$ by approximately 20% and the third speed $v_3$ is lower than the first speed $v_1$ by approximately 20%. As a result, the overlap or overlapping of the products 48 at the respective end regions of the imbricated product stream S and of the stream section S', which end regions are adjacent to the gap, is increased by such a minor proportion that the imbricated stream of products can be readily processed by the flow-downstream arranged processing station. Of course, if required, the gap-forming device 12 can be adjoined by an apparatus serving the purpose of evening the overlap, i.e. the mutual spacing or pitch of the products in the imbricated formation. However, it is to be remarked that the two second conveyors 14' and 14'' are driven always at the same first speed $v_1$, with the result that the processing speed of the flow-downstream arranged stations does not have to be varied or changed.

The differences between the speeds $v_1$ and $v_2$ and between the speeds $v_1$ and $v_3$ can be larger or smaller than 20%. The speed differences preferably lie between 10% and 50%, but this should not represent any absolute limitation.

The apparatus 100 constructed according to the invention is particularly suitable for forming gaps in imbricated streams of printed products such as newspapers, magazines and the like.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming a gap in an imbricated product stream of substantially flat products, particularly printed products, comprising:

a first conveyor driven at a predetermined first speed and having a predetermined product conveying direction;

at least one second conveyor arranged downstream of said first conveyor as viewed in said predetermined product conveying direction;

a gap-forming device arranged between said first conveyor and said at least one second conveyor;

said gap-forming device having first conveying means and second conveying means;

said second conveying means extending substantially parallel to said first conveying means;

said first conveying means being drivable substantially at said predetermined first speed for the purpose of conveying the imbricated product stream supplied by said first conveyor to said at least one second conveyor;

one of said conveying means being drivable, for the purpose of forming a gap, at a predetermined second speed which is higher with respect to said predetermined first speed, in order to feed the products located in the region of said gap-forming device at the beginning of gap formation to said at least one second conveyor;

the other one of said conveying means being drivable, for the purpose of forming a gap, at most at said predetermined first speed in order to take over and further convey the products supplied by said first conveyor;

said at least one second conveyor being driven at approximately said predetermined first speed in order to take over and further convey, with an increase in mutual overlap, the products supplied by said one of said conveying means driven at said predetermined second speed; and said other one of said conveying means being drivable during gap formation at a predetermined third speed which is lower with respect to said predetermined first speed in order to take over and further convey, likewise with an increase in mutual overlap, the products supplied by said first conveyor.

2. The apparatus as defined in claim 1, wherein:

said first conveying means and said second conveying means of said gap-forming device are respectively structured as belt conveyors;

one of said belt conveyors comprising a conveyor belt having an operative region of a predetermined length;

said conveyor belt being provided with passages in a section thereof whose length approximately corresponds to said predetermined length of said operative region; and a negative pressure source is connectable in said operative region with said passages in order to conveying-actively connect respective products with said conveyor belt and retain the respective products thereat.

3. The apparatus as defined in claim 2, wherein:

the other one of said belt conveyors defines a conveying plane for the products;

said operative region of said conveyor belt constituting the conveying-active run of the latter; and said conveying-active run of said conveyor belt being located beneath said conveying plane of said other one of said belt conveyors.

4. The apparatus as defined in claim 3, wherein:

said conveyor belt is drivable during gap formation at said predetermined second speed; and said other one of said belt conveyors is drivable at approximately said predetermined first speed for transporting the imbricated product stream and at said predetermined third speed for forming a gap.

5. The apparatus as defined in claim 4, further including:

a suction trough impingeable with a negative pressure at the beginning of gap formation;

said conveying-active run of said conveyor belt being guided over said suction trough; and said section of said conveyor belt comprising said passages being located in the region of said suction trough at the beginning of gap formation.

6. The apparatus as defined in claim 5, wherein:

said conveyor belt is structured as an endless conveyor belt;

said endless conveyor belt having a predetermined length; and said section provided with said passages covering approximately one half of said predetermined length of said endless conveyor belt.

7. The apparatus as defined in claim 6, wherein:

said other one of said belt conveyors comprises two transport belts; and said endless conveyor belt being arranged between said two transport belts.

8. The apparatus as defined in claim 7, further including:

a driving arrangement;

said gap-forming device having a receiving end and a delivery end;

a first common shaft arranged at said receiving end of said gap-forming device;

rolls respectively seated upon said first common shaft for said two transport belts and said endless conveyor belt;

said first common shaft being coupled with said rolls provided for said two transport belts in a manner such as to be non-rotatable relative to said rolls;

said first common shaft being drivable by means of said driving arrangement at said predetermined first speed and at said predetermined third speed, respectively;

a second common shaft arranged at said delivery end of said gap-forming device;

rolls respectively seated upon said second common shaft for said two transport belts and said endless conveyor belt;

said second common shaft being coupled with said roll provided for said endless conveyor belt in a manner such as to be non-rotatable relative to said roll; and said second common shaft being drivable by means of said driving arrangement at said predetermined second speed.

9. The apparatus as defined in claim 8, further including:

first coupling means;

a free-wheel active in said predetermined product conveying direction;

said driving arrangement comprising a driving motor and transmission means;

said first common shaft being connected to said driving motor by means of said first coupling means as well as by means of said free-wheel;

said transmission means between said driving motor and said first common shaft being structured such that said two transport belts revolve, when said first coupling means are engaged and said free-wheel is active, at a speed approximately corresponding to said predetermined first speed and, when said first coupling means are disengaged and said free-wheel is inactive, at said predetermined third speed which is lower than said predetermined first speed;

second coupling means;

said second common shaft being connected to said driving motor by means of said second coupling means; and said second common shaft driving said endless conveyor belt at said predetermined second speed when said second coupling means are engaged.

10. The apparatus as defined in claim 9, wherein:

said first conveyor is drivable by means of said driving motor.

11. The apparatus as defined in claim 9, wherein:

said at least one second conveyor is drivable by means of said driving motor.

12. The apparatus as defined in claim 1, wherein:

said predetermined second speed is between 10% and 50% higher than said predetermined first speed; and said predetermined third speed is between 10% and 50% lower than said predetermined first speed.

13. The apparatus as defined in claim 1, wherein:

said predetermined second speed is approximately 20% higher than said predetermined first speed; and said predetermined third speed is approximately 20% lower than said predetermined first speed.

14. The apparatus as defined in claim 1, wherein:

said at least one second conveyor constitutes two second conveyors; and said gap-forming device being constructed as a switch pivotable to-and-fro between said two second conveyors.

15. The apparatus as defined in claim 14, wherein:

said first conveying means and said second conveying means of said gap-forming device are respectively structured as belt conveyors;

one of said belt conveyors comprising a conveyor belt having an operative region of a predetermined length;

said conveyor belt being provided with passages in a section thereof whose length approximately corresponds to said predetermined length of said operative region; and a negative pressure source is connectable in said operative region with said passages for conveying-actively connecting respective products with said conveyor belt and retaining the respective products thereat.

16. The apparatus as defined in claim 15, wherein:

the other one of said belt conveyors defines a conveying plane for the products;

said operative region of said conveyor belt constituting the conveying-active run of the latter; and said conveying-active run of said conveyor belt being located beneath said conveying plane of said other one of said belt conveyors.

17. The apparatus as defined in claim 16, wherein:

said conveyor belt is drivable during gap formation at said predetermined second speed; and said other one of said belt conveyors is drivable at approximately said predetermined first speed for transporting the imbricated product stream and drivable at said predetermined third speed for forming a gap.

18. The apparatus as defined in claim 17, further including:

a suction trough impingeable with a negative pressure at the beginning of gap formation;

said conveying-active run of said conveyor belt being guided over said suction trough; and said section of said conveyor belt comprising said passages being located in the region of said suction trough at the beginning of gap formation.

19. The apparatus as defined in claim 18, wherein:

said conveyor belt is structured as an endless conveyor belt;

said endless conveyor belt having a predetermined length; and said section provided with said passages covering approximately one half of said predetermined length of said endless conveyor belt.

20. The apparatus as defined in claim 19, wherein:

said other one of said belt conveyors comprises two transport belts; and said endless conveyor belt being arranged between said two transport belts.

21. The apparatus as defined in claim 20, further including:

a driving arrangement;

said gap-forming device having a receiving end and a delivery end;

a first common shaft arranged at said receiving end of said gap-forming device;

rolls respectively seated upon said first common shaft for said two transport belts and said endless conveyor belt;

said first common shaft being coupled with said rolls provided for said two transport belts in a manner such as to be non-rotatable relative to said rolls;

said first common shaft being drivable by means of said driving arrangement at said predetermined first speed and at said predetermined third speed, respectively;

a second common shaft arranged at said delivery end of said gap-forming device;

rolls respectively seated upon said second common shaft for said two transport belts and said endless conveyor belt;

said second common shaft being coupled with said roll provided for said endless conveyor belt in a manner such as to be non-rotatable relative to said roll; and said second common shaft being drivable by means of said driving arrangement at said predetermined second speed.

22. The apparatus as defined in claim 21, further including:

first coupling means;

a free-wheel active in said predetermined product conveying direction;

said driving arrangement comprising a driving motor and transmission means;

said first common shaft being connected to said driving motor by means of said first coupling means as well as by means of said free-wheel;

said transmission means between said driving motor and said first common shaft being structured such that said two transport belts revolve, when said first coupling means are engaged and said free-wheel is active, at a speed approximately corresponding to said predetermined first speed and, when said first coupling means are disengaged and said free-wheel is inactive, at said predetermined third speed which is lower than said predetermined first speed;

second coupling means;

said second common shaft being connected to said driving motor by means of said second coupling means; and said second common shaft driving said endless conveyor belt at said predetermined second speed when said second coupling means are engaged.

23. The apparatus as defined in claim 22, wherein:

said first conveyor is drivable by means of said driving motor.

24. The apparatus as defined in claim 22, wherein:

said two second conveyors are drivable by means of said driving motor.

25. The apparatus as defined in claim 15, wherein:

said predetermined second speed is between 10% and 50% higher than said predetermined first speed; and said predetermined third speed is between 10% and 50% lower than said predetermined first speed.

26. The apparatus as defined in claim 15, wherein:

said predetermined second speed is approximately 20% higher than said predetermined first speed; and said predetermined third speed is approximately 20% lower than said predetermined first speed.

* * * * *